US007150586B2

(12) United States Patent
Fisher et al.

(10) Patent No.: US 7,150,586 B2
(45) Date of Patent: Dec. 19, 2006

(54) WINE MUST AND POMACE PUMP

(75) Inventors: Michael G. Fisher, San Jose, CA (US); Eric R. Garcia, Modesto, CA (US)

(73) Assignee: Therma Corporation, Inc., San Jose, CA (US)

( * ) Notice: Subject to any disclaimer, the term of this patent is extended or adjusted under 35 U.S.C. 154(b) by 6 days.

(21) Appl. No.: 10/726,070

(22) Filed: Dec. 2, 2003

(65) Prior Publication Data

US 2004/0166000 A1 Aug. 26, 2004

Related U.S. Application Data

(63) Continuation-in-part of application No. 10/634,421, filed on Aug. 5, 2003.

(60) Provisional application No. 60/404,185, filed on Aug. 16, 2002.

(51) Int. Cl.
*B01D 53/60* (2006.01)

(52) U.S. Cl. ..... 406/169

(58) Field of Classification Search ..... 55/430, 55/431, 432, 433, 466; 406/67, 169, 171
See application file for complete search history.

(56) References Cited

U.S. PATENT DOCUMENTS 2,946,626 A * 7/1960 Atkinson et al. ..... 406/67
4,085,975 A * 4/1978 Bilkvist ..... 406/109
4,572,726 A * 2/1986 Van Abbema ..... 55/337

* cited by examiner

*Primary Examiner*—Robert A. Hopkins
(74) *Attorney, Agent, or Firm*—Henneman & Associates, PLC; Larry E. Henneman, Jr.

(57) ABSTRACT

A wine must pump (10) for pumping a wine product (23) such as must or pomace, has an intake port (14) for receiving the wine product (23), a discharge port (16) for discharging the wine product (23) under pressure, vacuum chamber (20), connected to the inlet port (14), for receiving and separating wine product (23) from air, a pressure valve (26) for allowing the wine product (23) to be removed from the vacuum chamber (20) and an air pump (18) for providing the vacuum and forced air. A thermal transfer unit (28) removes heat from air exiting the air pump (18) such that the wine product (23) is not harmed thereby. A demister (39) removes moisture from recycled air entering the air pump (18). Silencers (74), (76) and (86), and an air pump sound box (110), provide for the quiet operation of the wine must pump (10). Optionally, process air can be injected between the vacuum chamber (20) and the pressure valve (26) to prevent clogging at the bottom of the vacuum chamber (20).

18 Claims, 8 Drawing Sheets

WINE MUST AND POMACE PUMP

RELATED APPLICATIONS

This application is a continuation-in-part of U.S. patent application Ser. No. 10/634,421, filed Aug. 5, 2003 by the same inventors, which claims priority to U.S. Provisional Patent Application Ser. No. 60/404,185, filed Aug. 16, 2002 by the same inventors, each of which is incorporated herein by reference in its entirety.

BACKGROUND

1. Field of the Invention

This invention relates generally to the field of mechanical material moving apparatus, and also to the field of wine making, and more particularly to a system for pumping wine musts and pomaces. The predominant current usage of the invention is for a pump for pumping wine pomace to a pressing process after the free run wine is removed.

2. Description of the Related Art

Wine making is a lengthy process involving many critical steps. For purposes of the present invention, the wine making process can be summarized by the following method. First, the wine grapes are crushed into a must containing both grape juice and solids. The must is then placed into a fermentation tank in which it is fermented for approximately eight to fourteen days. The free run wine is then removed from the fermentation tank leaving a wet mixture of wine pomace (the grape solids in addition to a small amount of leftover free run wine), which is often then transferred to presses to extract additional wine.

There are three known methods for transferring the wine pomace from the fermentation tank to another process, such as a pressing process. One method is to attach an auger to the bottom of the fermentation tank. When the auger rotates, the pomace is fed into a transport bin, a winery piping system, a belt conveyor, or the like, in order to transport the pomace to the next process. The primary drawback of using augers to transport wine pomace is the expense. Typically, each auger can cost between $250,000 and $500,000, thereby creating large overhead costs for the winery.

A "dig" method can also be used to remove wine pomace from the fermentation tank. In the dig method, a worker enters the fermentation tank to shovel the wine pomace through a hole in the tank and into a transport bin. A concern with using the dig method is safety. The confined space and oxygen deprived environment within the fermentation tank presents a worker hazard. Also, the fermentation tanks are sometimes angled near the bottom and workers might slip and become injured. Also, in at least some jurisdictions it is required that a standby worker and a designated rescue person be on hand when a worker enters the fermentation tank. Therefore, a method which could accomplish the task without requiring a worker to enter the tank would reduce employee cost, as well.

Yet another method for removing the pomace is a sluicing method. In the sluicing method a portion of the free run wine is injected into the pomace to form a slurry of wine and pomace. The slurry is then pumped through winery piping or into transport bins. However, passing the wine slurry through a pump is undesirable because grape seeds are broken and skins are shredded. The broken seeds and skins can have an adverse effect on the appearance and/or taste of the wine.

One disadvantage when using methods such as those described above to transport wine must and pomace is that the wine product is excessively exposed to atmospheric air, which is higher in oxygen concentration than the air within and surrounding the fermentation tank(s). The exposure to increased oxygen levels during transport can have detrimental effects on the wine quality.

What is needed, therefore, is a system for moving wine musts and pomaces that is both cost effective and safe to wine makers and employees, and further that will not adversely affect the wine musts and pomaces during the pumping process, such as by increasing the wine product's exposure to oxygen during transport.

SUMMARY

Accordingly, it is an object of the present invention to provide a method and apparatus for transporting wine grape pomace that will not adversely affect the taste or quality of the resultant wine.

It is another object of the present invention to provide a method and apparatus for transporting wine grape pomace that is safe for the workers involved in the operation.

It is yet another object of the present invention to provide a method and apparatus for transporting wine grape pomace that is easy and economical to accomplish.

It is another object of the present invention to provide a method and apparatus for transporting wine grape pomace that does not unnecessarily increase exposure of the wine grape pomace to atmospheric air.

It is still another object of the present invention to provide a method and apparatus for transporting wine grape pomace that can readily be adapted for use with existing winery apparatus.

The present invention overcomes the problems associated with the prior art by providing a system for cost effectively and safely pumping wine grape must and/or pomace for processing without damaging the wine product.

In one embodiment of the invention, a pump for pumping a wine product such as must or pomace has an inlet port for receiving the wine product, a discharge port for discharging the wine product under pressure, a vacuum chamber connected to the inlet port for receiving and separating wine product from air, a mixing valve for mixing the separated wine product with compressed air, and at least one air pump for supplying vacuum to the vacuum chamber and for providing compressed air to the mixing valve.

The pump also has a pressure valve interposed between the vacuum chamber and the mixing valve. The embodiments described also include a heat exchanger interposed between the air pump and the mixing valve for adding or removing thermal energy from the compressed air.

In a particular embodiment, the vacuum chamber includes an air inlet valve that allows air to flow into the vacuum chamber to agitate the wine product, thereby preventing clogging of the pressure valve. The air inlet valve can allow room air to flow into the vacuum chamber, can be coupled to receive pressurized air from the air pump, optionally via the outlet of the heat exchanger, or can be coupled to receive a pressurized gas from a compressed fluid supply. Optionally, the flow rate of air entering the air inlet valve is controlled by a regulating valve.

By way of example, the air pump is a blower unit, the pressure valve is a rotary airlock, and the thermal transfer unit is a heat exchanger for removing heat from the compressed air supplied by the blower unit. The pump includes several silencers for reducing the noise produced by the blower, as well as a butterfly valve for controlling the amount of vacuum pressure created in the vacuum chamber.

A demister is also optionally provided in one embodiment for reducing the vapor content of air approaching an inlet of the air pump.

These and other objects and advantages of the present invention will become clear to those skilled in the art in view of the description of modes of carrying out the invention, and the industrial applicability thereof, as described herein and as illustrated in the several figures of the drawing. The objects and advantages listed or discussed herein are not an exhaustive list of all possible objects or advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and/or advantages. Accordingly, the listed objects and advantages are not essential elements of the present invention, and should not be construed as limitations.

DETAILED DESCRIPTION

Figure 1:
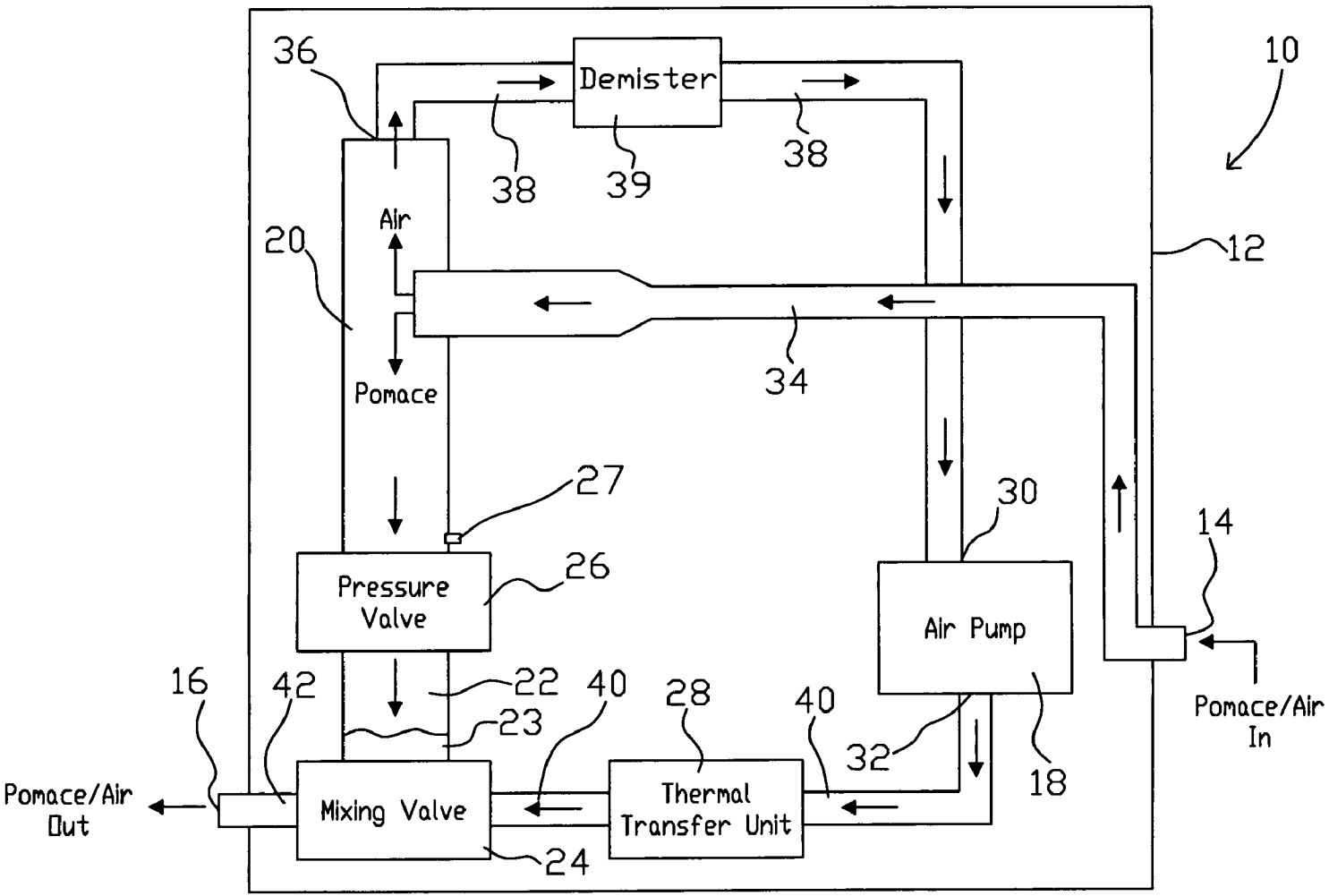
FIG. 1 is a block diagram of a wine must pump according to the present invention.

This invention is described in the following description with reference to the Figures, in which like numbers represent the same or similar elements. While this invention is described in terms of modes for achieving this invention's objectives, it will be appreciated by those skilled in the art that variations may be accomplished in view of these teachings without deviating from the spirit or scope of the present invention. The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations. In the following description, details of well known and/or commonly commercially available components, and the like, which are well known to those skilled in the art, have not been specifically discussed in detail, so as to avoid unnecessary complexity which might obscure disclosure of the true nature of the present invention.

A known mode for carrying out the invention is a wine must pump. The inventive wine must pump is depicted in a block diagramatic view in FIG. 1 and is designated therein by the general reference character 10. It should be noted that the present inventive wine must pump 10 is intended to be used for the transportation of wine must and/or pomace or some combination thereof. While these terms are not necessarily used interchangeably in the wine industry, as used herein it should be understood that these terms and/or the term "wine product" are used essentially interchangeably, and should be understood to be the material which is being operated upon using the present inventive apparatus and method.

The wine must pump 10 has a frame 12, an intake port 14, a discharge port 16, an air pump 18, a vacuum chamber 20, a depository 22 for accepting wine product 23, and a mixing valve 24. The wine must pump 10 further has a pressure valve 26 interposed between the vacuum chamber 20 and the depository 22, an adjustable agitator air inlet valve 27 into chamber 20 just above pressure valve 26, as well as a thermal transfer unit 28 interposed between the air pump 18 and the mixing valve 24. The air pump 18 also has an inlet port 30, and an air outlet port 32.

The components of the wine must pump 10 are connected in the following manner. The vacuum chamber 20 is connected to the intake port 14 via an intake conduit 34. Additionally, the vacuum chamber 20 has a vacuum port 36, which is connected to the inlet port 30 of the air pump 18 via a vacuum conduit 38. A demister 39 is located in the vacuum conduit 38. The air outlet port 32 of the air pump 18 is connected to the thermal transfer unit 28 via an outlet conduit 40, which passes through the thermal transfer unit 28. The mixing valve 24 is coupled to receive pomace from the depository 22, and to discharge the pomace at the discharge port 16 via a discharge conduit 42.

The components of wine the must pump 10 operate as follows. The frame 12 provides structure and mounting support for the components located therein. Must or pomace enters the wine must pump 10 via the intake port 14 from a fermentation tank, or the like (not shown), and exits the wine must pump 10 via the discharge port 16 into winery piping (not shown). The air pump 18 simultaneously supplies both vacuum and pressurized air to operate the wine must pump 10. Air is evacuated from the vacuum chamber 20 by the air pump 18, and a vacuum is created therein. The vacuum in the vacuum chamber 20 suctions the wine product from the intake port 14 through the intake conduit 34. Once in the vacuum chamber 20 the wine product drops through the pressure valve 26 into the depository 22, while any air is removed through the vacuum conduit 38. Agitator air inlet valve 27 allows air to be drawn into chamber 20 in order to agitate the wine product, which prevents clogging of pressure valve 26.

The mixing valve 24 mixes pressurized air from air pump 18 with the wine product from the depository 22, such that the pressurized air forces the wine product (the pomace and/or must, or the like) out through the discharge port 16. The pressure valve 26 (which will be discussed in more detail hereinafter) allows the wine product to fall therethrough from the vacuum chamber 20 while blocking the air path from the depository 22 to the vacuum chamber 20 such that pressurized air in the depository 22 does not flow into the vacuum chamber 20. The wine material in the depository 22 drops into the mixing valve 24 by the force of gravity. The thermal transfer unit 28 controls the temperature of the pressurized air by removing thermal energy therefrom.

The conduits introduced previously herein carry air and/or wine product through the wine must pump 10 as follows. Once the air pump 18 is powered on, air is evacuated from the vacuum conduit 38 through the inlet port 30. The vacuum conduit 38, in turn, lowers the air pressure within the vacuum chamber 20, which is at least partially sealed by pressure valve 26. The intake conduit 34 is connected to the vacuum chamber 20 near the top thereof, and is therefore also put under vacuum by the air pump 18. The pressure differential between the intake port 14, which is generally at approximately atmospheric pressure, and the vacuum chamber 20 causes the wine must or pomace and some air to be drawn through the intake conduit 34 and into the vacuum chamber 20. Wine product entering the vacuum chamber 20 falls toward the pressure valve 26, while any air entering the vacuum chamber 20 is drawn into the vacuum conduit 38. Since it would be undesirable to have too much moisture drawn into the air pump 18, the demister 39 is placed in the path of the vacuum conduit 38 to remove excess moisture therefrom. The outlet conduit 40 receives pressurized air from the air pump 18 through the air outlet port 32 and delivers it to the mixing valve 24, where it is mixed with wine must and/or pomace from the depository 22. The wine product, under force of the pressurized air, exits the mixing valve 24 into the discharge conduit 42, through which it is carried to the discharge port 16 and on to a winery piping system (not shown).

In summary, the wine must pump 10 operates generally as follows. The air pump 18 provides vacuum to the vacuum conduit 38 and thus to the vacuum chamber 20. Negative pressure in the vacuum chamber 20 draws in wine product and air through the intake conduit 34. Wine product and air are drawn into the intake conduit 34 through the intake port 14 (from an external tank through a connecting hose, neither of which is shown in the view of FIG. 1). The pomace/air mixture is separated generally by cyclonic action. One skilled in the art of material separation devices and practices will be generally familiar with cyclonic separation apparatus. Briefly, a cyclonic separator (such as the vacuum chamber 20) is generally conical in shape, such that material drawn into the separator with some force near the top start to swirl around the outside of the separator as they fall toward the bottom. Heavier materials (such as the wine pomace and/or must, in this example) are thrown to the outside of the separator and continue to fall toward the bottom, while lighter materials (moist air, in this example) are drawn toward the vacuum applied from the top of the separator. Accordingly, in the present invention, air is drawn out of the vacuum chamber 20 into the vacuum conduit 38, while the wine product falls to the bottom of the vacuum chamber 20 toward the depository 22. Air entering through inlet valve 27 breaks up any large clumps of wine product that might otherwise occlude the flow of material through pressure valve 26.

Figure 2:
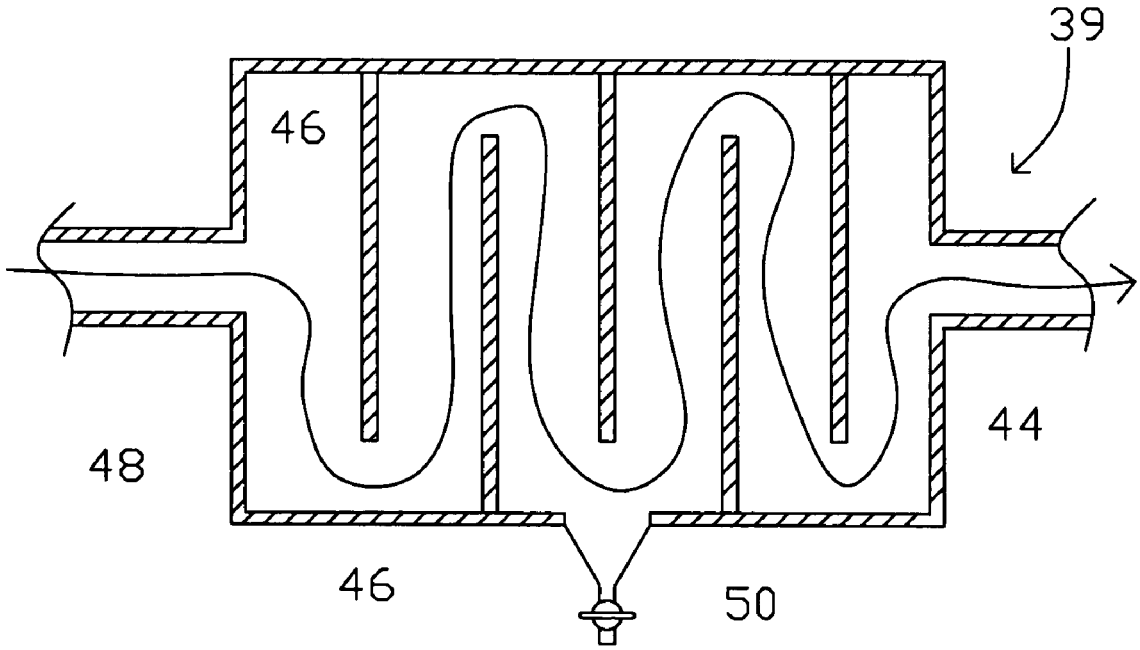
FIG. 2 is a diagrammatic, partially cross sectional, side elevational view of a demister as used in conjunction with an example of the inventive wine must pump.

Since the air drawn through the vacuum conduit 38 and into the air pump 18 contains some moisture and other wine residue which could be detrimental to the air pump 18, the inventors have found that it is advantageous to optionally add the demister 39 to remove the moisture and other contaminants. One skilled in the art will be generally familiar with demisters and they are generally commercially available. FIG. 2 is a diagrammatic cross sectional side elevational view of the demister 39 of this present example of the wine must pump 10. As can be seen in the view of FIG. 2, the demister 39 has an outer housing and a plurality (five are shown in this example, although a greater number may be desirable in practice) of baffles 46 such that an air path is forced to move past the baffles 46. As the moist air comes against the baffles 46, moisture condenses out of the air and falls to the bottom of the demister 39. A drain 50 is provided for selectively draining collected fluids from the demister 39. Although it may not always be necessary, in the example shown the baffles 46 are cooled to enhance condensation of the moist air.

As can be understood in light of the above discussion, the interior of the vacuum chamber 20 will be at a partial vacuum, while the depository 22 will be at or somewhat above atmospheric pressure. The pressure valve 26 allows the wine material to drop from the vacuum chamber 20 into the depository 22 while preventing air or other materials from moving from the depository 22 into the vacuum chamber 20. In the embodiment of the invention shown, the pressure valve 26 is a product discharge "dump" type valve, which is generally known in the art. However, any valve that is able to discharge wine product from vacuum chamber 20 into depository 22, while maintaining the negative pressure in vacuum chamber 20 can be employed in wine must pump 10.

Figure 3:
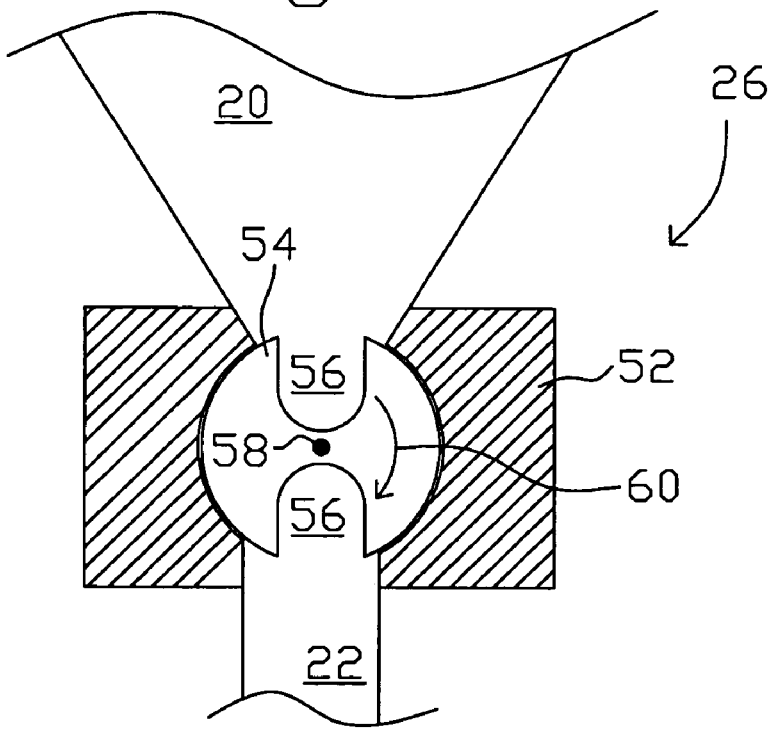
FIG. 3 is a diagrammatic, partially cross sectional, side elevational view of a pressure valve used in conjunction with an example of the inventive wine must pump.

FIG. 3 is a cross sectional side elevational view of the pressure valve 26 used on the example of the present inventive wine must pump 10 here described. As can be seen in the view of FIG. 3, the pressure valve 26 has a housing 52 and a rotating drum 54 with a plurality (two, in this example) of pockets 56 in the drum 54. The drum 54 rotates about a drum axis 58 as indicated by rotational arrow 60. As the drum 54 rotates, material from the vacuum chamber 20 falls into each of the pockets 56 in turn. As the drum 54 further rotates, the pockets 56 are occluded by the housing 52. As the drum 54 continues to rotate, the contents of each of the pockets 56 is, in turn, deposited by the force of gravity into the depository 22. As indicated above, air entering through air inlet valve 27 (FIG. 1) agitates the product dropping down toward drum 54 and prevents clumps of product from bridging over pockets 56 and preventing the transfer of product by valve 26.

Again referring to the view of FIG. 1, the air pump 18 pressurizes air taken in through the vacuum conduit 38, along with additional air as necessary, pressurizes it, and expels it through the air outlet port 32 into the outlet conduit 40. The pressurized air passes through the thermal transfer unit 28 where it is cooled, and into the mixing valve 24. In the mixing valve 24, the wine material from the depository 22 is introduced into the compressed air stream, and the mixture exits the mixing valve 24 into the discharge conduit 42, eventually exiting the wine must pump 10 through the discharge port 16.

Figure 4:
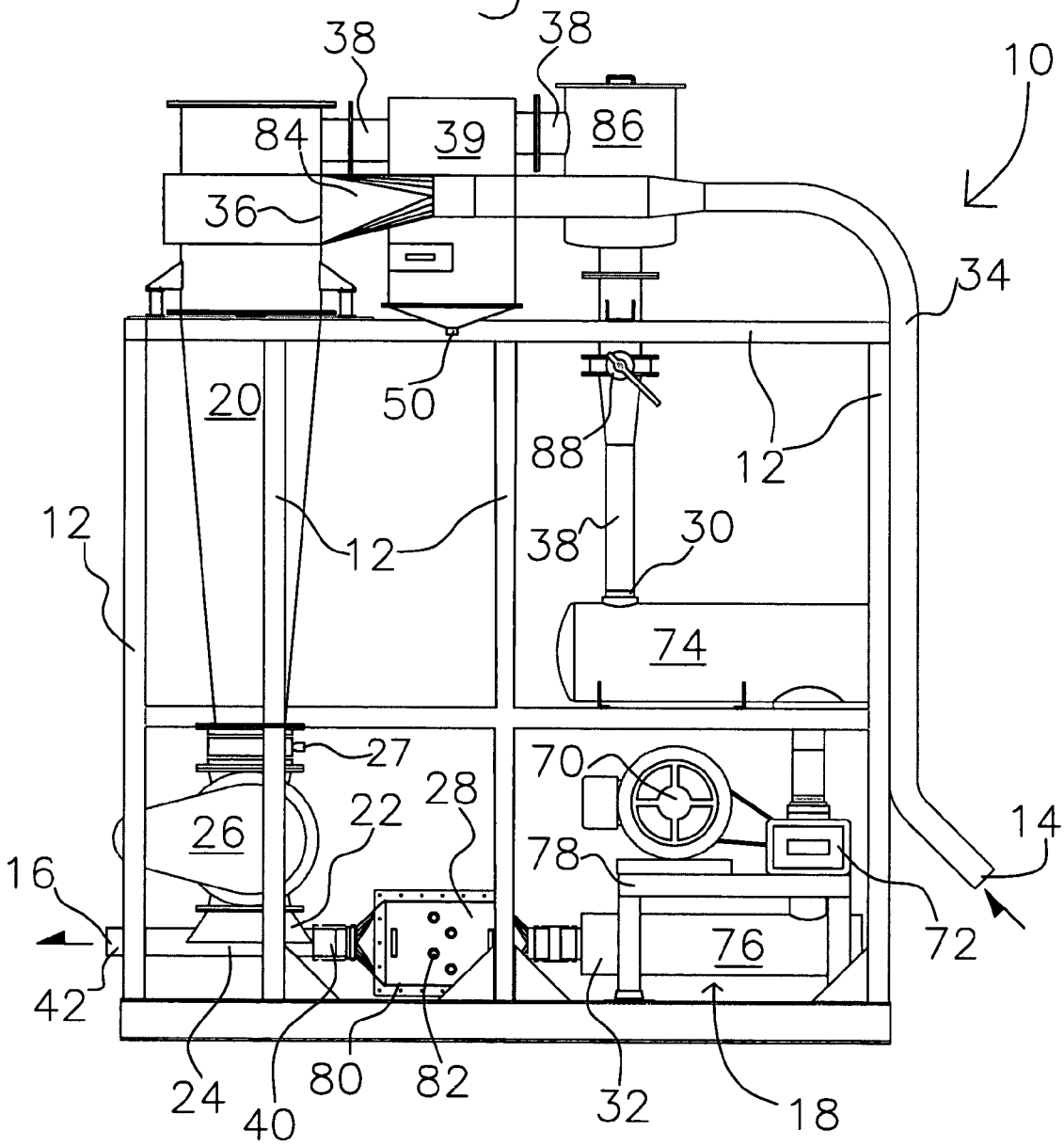
FIG. 4 is a side elevational view of an example of a wine must pump according to the present invention.

FIG. 4 is a side elevational view of the wine must pump 10, which serves to better show the form and physical relationship of the components thereof. Further, some optional components provided for silencing and the like are depicted in the view of FIG. 4 which were not previously discussed in relation to the operational block diagram of FIG. 1. Like numbers in FIGS. 1 and 4 indicate that the corresponding elements shown in the view of FIG. 4 essentially as described in relation to the example of FIG. 1. Electrical wiring and controls are omitted from the view of FIG. 4 for the sake of clarity.

In the view of FIG. 4 it can be seen that the air pump 18 has a motor 70, a blower 72, an intake silencer 74 and a discharge silencer 76. The silencers 74 and 76 are conventional canister type silencers which are known to one skilled in the art. The air pump 18 further has a sound enclosure with sound enclosure ventilation fan which are omitted from the view of FIG. 4 in order to show the internal components. The air pump 18 is commercially available from Kaeser™ Compressors, Inc. located in Fredericksburg, Va., as model Omega Pak DB235, 40 horsepower.

The air pump 18 functions as a blower by pumping air from the inlet port 30 to the air outlet port 32. Air enters the air pump 18 through the inlet port 30. The intake silencer 74 muffles sounds created by the air as it travels toward the blower 72, as well as sounds created directly by the blower 72. The motor 70 drives the blower 72. The blower 72 pressurizes and expels air into the discharge silencer 76. The discharge silencer 76 serves as a stagnation chamber for muffling and channeling the pressurized air exhausted from the blower 72. The motor 70 and the blower 72 are supported by a blower frame 78.

As can also be seen in the view of FIG. 4, the vacuum chamber 20 is generally conical in shape such that the cyclonic action previously discussed herein is encouraged, and further to direct the wine product therein into the pressure valve 26. In the example of the invention here described, the vacuum chamber 20 is custom fabricated. However, similar devices (cyclone separators, and the like) are commercially available and may be substituted for the vacuum chamber 20.

The thermal transfer unit 28 is a commercially available heat exchanger that removes heat from the compressed air exiting the air outlet port 32 of the air pump 18. The thermal transfer unit 28 has an air chamber 80 and a fluid coil 82 (end connections shown) disposed therein for accepting and passing therethrough cooled fluid from an external cooled fluid source (not shown) which is, in this example, a simple tap water connection. In the example of the invention here described, the thermal transfer unit 28, including the air chamber 80, is custom fabricated to fit within the confines of the frame 12 as well as to properly engage additional components of wine must pump 10 as shown and described herein. The fluid coil 82 is disposed within the air chamber 80 and is adapted to draw heat out of the compressed air moving through the air chamber 80. In this particular embodiment, fluid coil 82 is a Heat Craft™, model number 5WS1410F industrial grade fluid coil.

Without the thermal transfer unit 28, compressed air exiting the air pump 18 can reach temperatures as high as 200 degrees Fahrenheit. Cooling the compressed air, while not essential, is desirable in order to prevent flashing (killing) the active yeast in the wine product, and to prevent other detrimental effects to the wine product.

As previously discussed herein, the pressure valve 26 is a rotary air lock that separates the vacuum chamber 20 from the depository 22. The pressure valve 26 operates using a ¾ horsepower motor to drive the drum 54 (FIG. 3). The drum 54 spins at a rate of about 20 to 30 revolutions per minute, which rate may vary depending upon the size of the pockets 56 in the drum 54, the rate at which the wine material must be moved, and the like. The pressure valve 26 is available as a rotary air valve from Mac Equipment Company, Kansas City, Mo., as model number EMD20. Air inlet valve 27 is a manually operated 1.5 inch ball valve.

As can be seen in the view of FIG. 4, in this embodiment of the invention, the intake conduit 34 transitions to a rectangular section 84 just prior to entering the vacuum chamber 20. The rectangular section 84 is joined (by welding, in this embodiment) to the vacuum chamber 20 near the top thereof, as has been discussed in some detail herein before, such that the wine material passes into the vacuum chamber 20.

As can further be seen in the view of FIG. 4, in this example of the invention the vacuum conduit 38 has inline therewith an inline silencer 86 and a butterfly valve 88. The inline silencer 86 is removably capped for cleaning purposes. The inline silencer 86 is a hollow chamber type silencer which serves to muffle the sounds produced in the vacuum conduit 38. The inline silencer 86 is manufactured by Solberg Manufacturing, Inc. of Itasca, Ill., as part number CSL275P600F. The butterfly valve 88 controls the vacuum pressure in the vacuum conduit 38 and, therefore, in the vacuum chamber 20 as well.

Figure 5A:
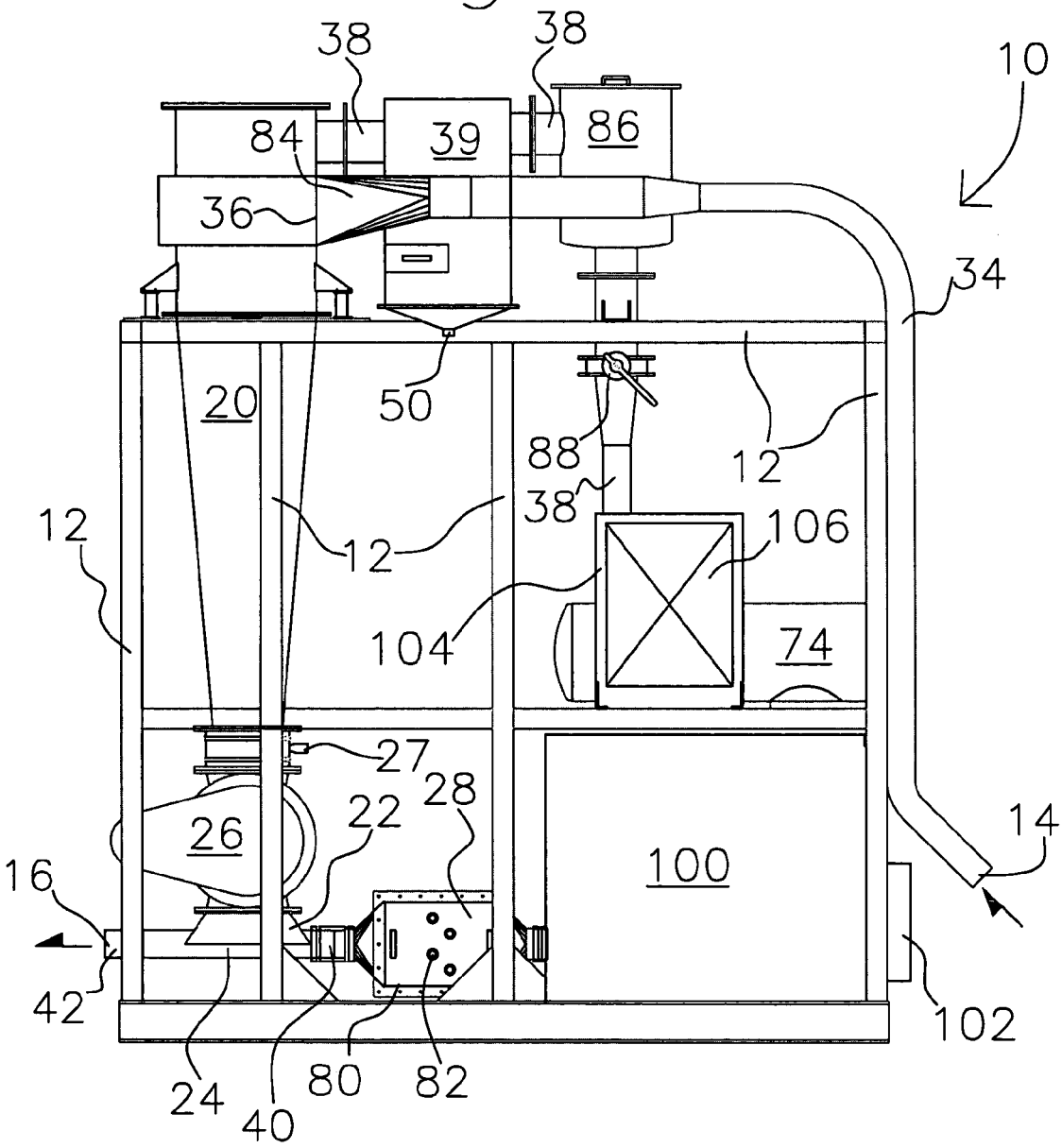
FIG. 5A is a side elevational view of the wine must pump of FIG. 4, showing some additional components that were omitted from the view of FIG. 4.

FIG. 5A is a side elevational view of the example of the wine must pump 10 also shown in FIG. 4. In the view of FIG. 5A, some additional components are shown which were omitted from the view of FIG. 4 in order to show components therebehind. As can be seen in the view of FIG. 5A, the air pump 18 (FIG. 4) is covered with an air pump sound box 100 in the actual practice of the present invention. The air pump sound box 100 is an insulated enclosure which helps to lessen the sound emanating from the air pump 18. In order to keep the air pump 18 sufficiently cool, an air pump ventilator fan 102 is provided on the air pump sound box 100.

Also visible in the view of FIG. 5A is a control box 104. The control box 104 has electronic controls for turning on and off, and otherwise controlling the other components of the wine must pump 10 as described herein, and indicator lights for indicating the status of such components. Also the control box 104 has gauges for monitoring the air pressures and flow rates described herein. An optional control panel cover 106 protects the controls in the control box 104 from breakage and also from unwanted tampering with the controls.

Figure 5B:
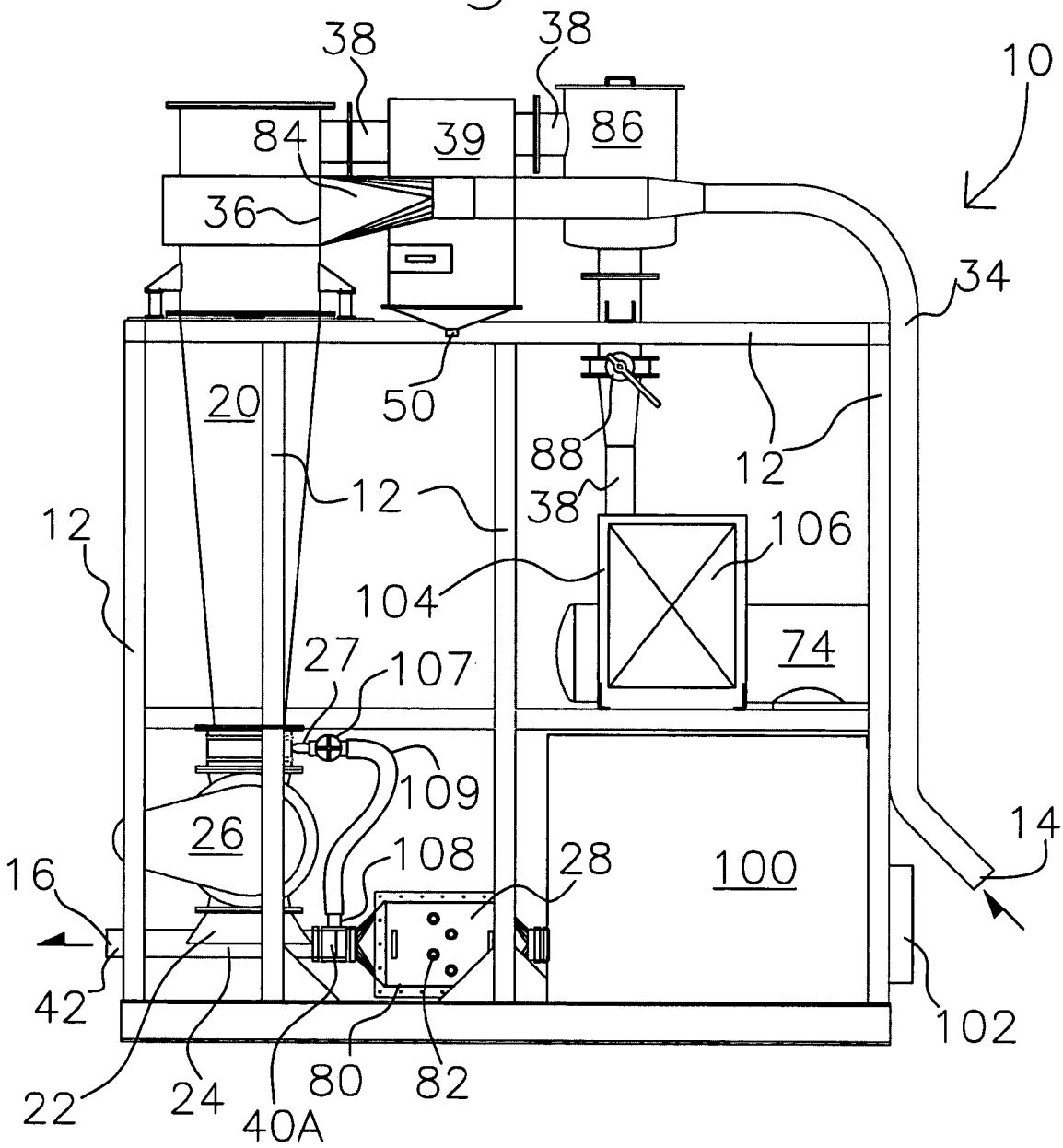
FIG. 5B is side elevational view of the wine must pump of FIG. 4, showing an optional coupling which provides air from the air pump to the air inlet valve of the vacuum chamber.

FIG. 5B is another side elevational view of wine must pump 10 showing an optional coupling which provides air from air pump 18 (FIG. 4) to air inlet valve 27 of vacuum chamber 20. The coupling includes a regulating valve 107 mounted to inlet valve 27, an alternate outlet conduit 40A with an access port 108, and an agitation air conduit 109 connecting regulating valve 107 with access port 108. Access port 108 permits cooled and pressurized air to flow from air outlet conduit 40A into agitation air conduit 109. In a particularly simple embodiment, alternate air outlet conduit 40A is a tee fitting connected to the outlet of thermal transfer unit 28. Regulating valve 107 is coupled directly to air inlet valve 27, and controls the flow rate of compressed air entering air inlet valve 27. As discussed previously, air entering air inlet valve 27 is used to break up clumps of wine product falling into pressure valve 26. In a particularly simple embodiment, regulating valve 107 is a manual ball valve. However any valve, manual or electronic, designed to regulate the flow of air could be used. Finally, air conduit 109 directs pressurized air from access port 108 to regulating valve 107 and, in the present embodiment, is fabricated from stainless steel, although other types of tubing (e.g., pressure-rated rubber hose) could be used. The diameter of air conduit 109 can be adjusted as required for specific applications, pump sizes, etc.

It should be noted that the volume flow rate of air out of thermal transfer unit 28 is enough to adequately supply air inlet valve 27 and mixing valve 24 with pressurized air. Also, the volume flow rate of air supplied through air inlet valve 27 is relatively small compared to the volume flow rate of air through mixing valve 24, and so should not adversely affect the performance of vacuum chamber 20.

Utilizing process air exiting thermal transfer unit 28 to break up the clumps of pomace in vacuum chamber 20 provides several important advantages. For example, the process air pumped through wine must pump 10 (and thus through air conduit 109) contains a lower amount of oxygen than atmospheric air. This is due to the fact that the majority of air drawn into wine must pump 10 via intake port 14 is from the environment of the fermentation tank where the fermenting wine was stored, and will contain relatively high concentrations of gases (e.g., carbon dioxide) produced during fermentation. Therefore, the wine product falling through vacuum chamber 20 into pressure valve 26 will be exposed to relatively lower concentrations of oxygen than if room air were permitted to flow into inlet valve 27, thereby reducing the adverse effects of oxygen on the wine product. Further, using the cooled air exiting thermal transfer unit 28 reduces the chance of adverse heat effects on the wine product passing through vacuum chamber 20.

Figure 5C:
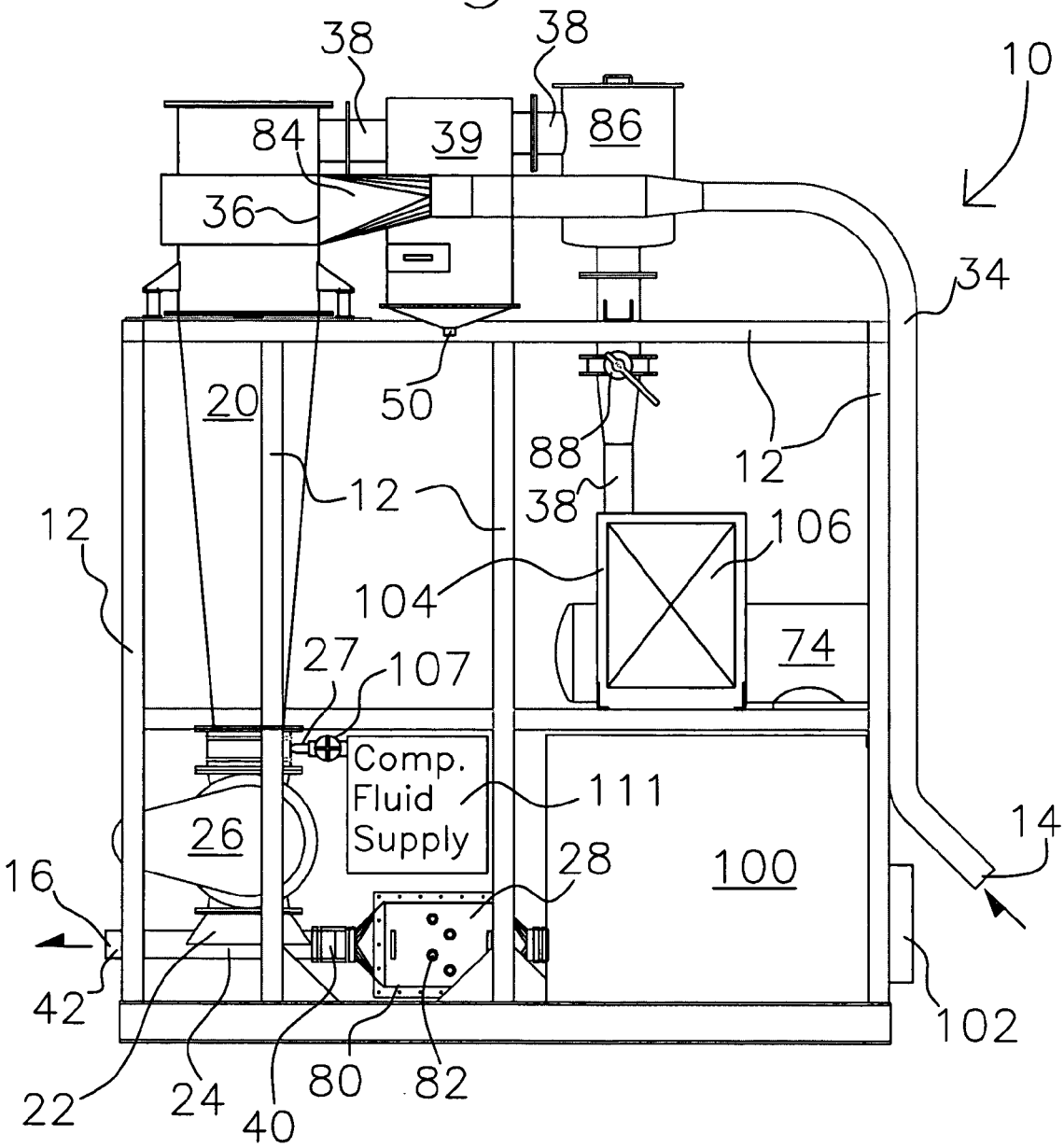
FIG. 5C is side elevational view of the wine must pump of FIG. 4, showing an optional compressed fluid supply which provides a compressed fluid to the air inlet valve of the vacuum chamber.

FIG. 5C is another side elevational view of wine must pump 10 showing an optional compressed air source 111 that supplies a compressed gas to air inlet valve 27. In the embodiment shown, the flow of compressed gas supplied to air inlet valve 27 can be regulated by regulating valve 107. In a particularly simple embodiment, compressed fluid supply 111 is a tank of compressed gas (e.g., nitrogen) that is known not to adversely affect the wine product in vacuum chamber 20. However, compressed fluid supply 111 can be any system (e.g., a winery plumbing system) that delivers a fluid to inlet valve 27 that is safe to the wine product. Although shown on the interior in FIG. 5C, compressed fluid supply 111 can be situated inside or outside wine must pump 10 depending on the application.

Figure 6:
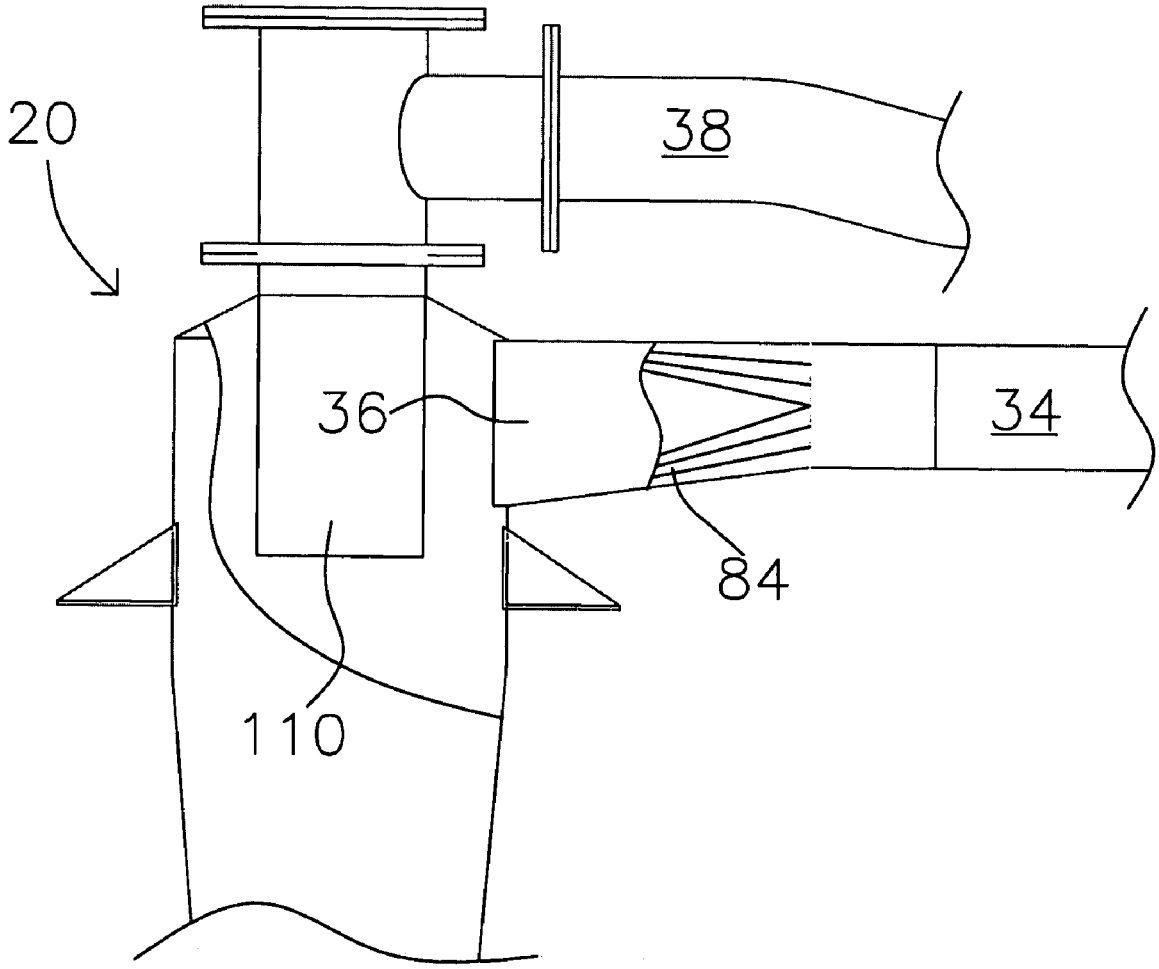
FIG. 6 is a more detailed, partially cut away, elevational view of a portion of the vacuum chamber of the present invention.

FIG. 6 is a partially cut away detail view of the top portion of the vacuum chamber 20 of FIGS. 4 and 5, and portions of the surrounding components. Through the cut away in the view of FIG. 6 it can be seen that the vacuum conduit 38 has a vacuum conduit extension 110 inside the vacuum chamber 20. The vacuum conduit extension 110 brings the point where the moist air is vacuumed from the vacuum chamber 20 below the vacuum port 36 where the wine product is drawn into the vacuum chamber 20 from the intake port 14. This allows the wine product to begin the cyclonic action hereinbefore described without interference from the stream of air entering the vacuum conduit extension 110. Indeed, one skilled in the art will recognize that the stream of air entering the vacuum conduit extension 100 forms somewhat of a column about which the cyclonic action carrying the wine product can swirl.

Figure 7:
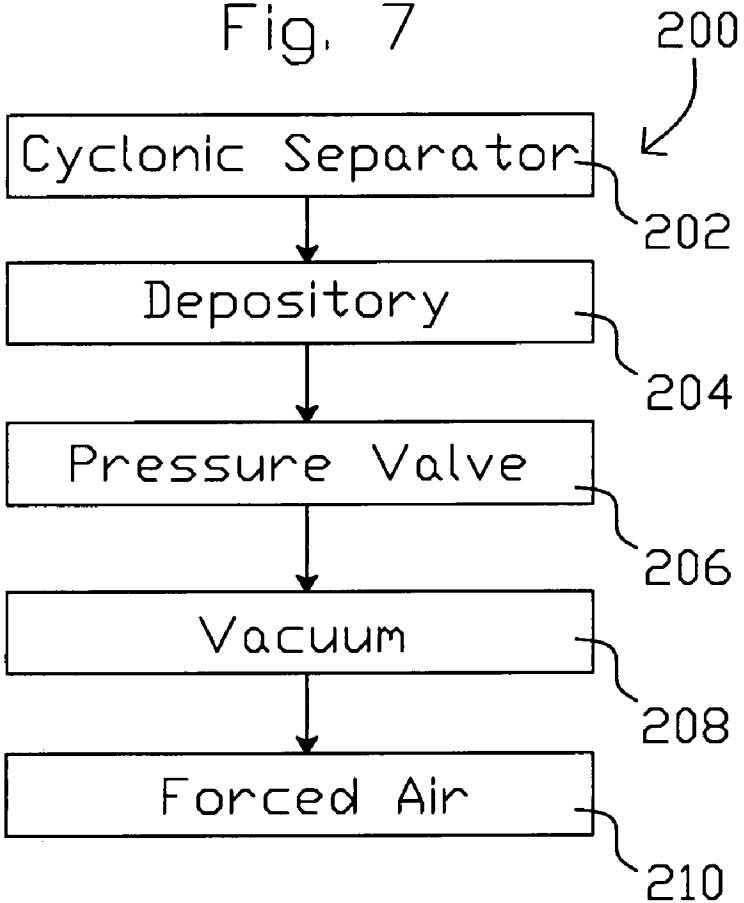
FIG. 7 is a flow diagram depicting an example of the present inventive method.

FIG. 7 is a block flow diagram depicting a simple version of an inventive wine must transport method 200. In a "provide separator" 202 operation a cyclonic separator, such as the vacuum chamber 20. is either construction (as in the embodiment of the wine must pump 10 described herein) or else purchased from one of the manufacturers who provide these. In a "provide depository" operation 204 a depository, such as the depository 22, is provided under the separator to receive wine product which has separated to the bottom of the separator. In a "provide pressure valve" operation 206, a device for allowing the wine product to move from the separator to the depository, such as the example of the rotary valve type pressure valve 26 described herein, is placed between the separator and the depository. In a "provide vacuum" operation 208 vacuum, or a means for producing vacuum, is provided to the separator for drawing product thereinto. In a "provide forced air" operation 210 forced air, or a means for providing forced air, is applied to wine product falling from the depository to remove the wine product from the inventive wine must pump 10 or equivalent.

Figure 8:
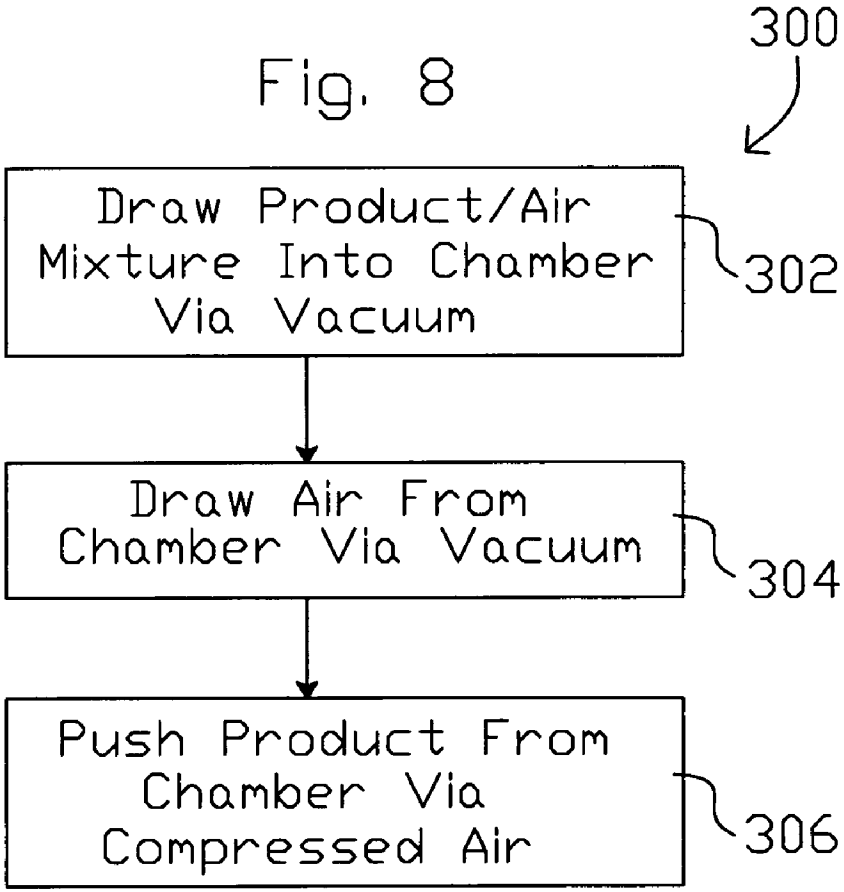
FIG. 8 is a flow diagram summarizing a method of moving product according to one aspect the present invention.

FIG. 8 is a flow diagram summarizing a method 300 for moving product according to one aspect of the present invention. In a first step 302 and air/product mixture is drawin into a chamber via vacuum. Next, in a second step 304, air from the mixture is drawn out of the chamber via vacuum. Then, in a third step 306, the product is pushed from the chamber via air. As used herein, the term air should be interpreted broadly to include any mixture of gasses present in the product environment.

It should be noted that, because wine making is a highly specialized and controlled process, the wine must pump 10 is manufactured with materials that are non-corrosive and that will not contaminate the wine product being pumped. In the presently described embodiment, most components that come in direct contact with the-wine product or operational air are constructed from stainless steel or are coated with a food grade Teflon™. Use of these materials provides a long operational life and further reduces the chance that wine products pumped through the wine must pump 10 will become contaminated.

Many of the above described features and/or components of the wine must pump 10 may be substituted, altered or omitted without departing from the scope of the invention. For example, alternate air pump assemblies may be substituted for the particular unit disclosed. As another example, the pumps described herein can be used to pump alternate fruit pomaces (such as crushed apples, orange pulp, or the like) created from other types of fruit processing. Indeed, a pump constructed according to the present invention can be used to pump other semi-solid products unrelated to the wine or fruit industry. It should be noted that the inventors have, indeed, tried some additional components for use with the wine must pump 10, which components have been found to be workable, but less effective than the components shown and described previously herein. One example of such component which has been tried has been a venturi apparatus for use where the mixing valve 24 described herein is used. While the venturi apparatus did work, it was found to clog easily and to be not as practical as the embodiment described. Another example is found in the shape of the vacuum chamber 20. The inventors have tried a "dual" inverted cone arrangement, where an upper cone fed into a lower cone. However, the inventors believe the embodiment shown and described herein to be superior for the intended applications. Nevertheless, it is within the scope of the invention that such variations might be found to be more advantageous for some future application, or for use in conjunction with different configurations and adaptations of the invention. These and other deviations from the particular embodiments shown will be apparent to those skilled in the art, particularly in view of the foregoing disclosure.

Still other various modifications may be made to the invention without altering its value or scope. For example, the sizes, shapes and quantities of components shown and described in relation to the examples discussed herein could each or all be varied according the needs or convenience of a particular application.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive wine must pump 10 and associated method 20 are intended to be widely used for the transportation of wine product. It is thought that the present invention will be particularly useful for those wineries that are presently either using manual labor to move their wine product about the winery, or else are using pumps or other apparatus that adversely affect the quality of the wine. As described herein, the wine must pump 10 and method 200 are efficient and economical in operation. According to the example of the invention shown and described herein, particular economy is obtained because the same air pump 18 provides both the necessary vacuum and forced air, thereby greatly reducing the cost or producing and operating the wine must pump 10. Also, the size of such an apparatus is kept to a minimum according to this invention, as is the amount of noise produced, which is a significant consideration in a winery.

The present invention overcomes the problems associated with the prior art, by providing a system for cost effectively pumping wine musts and pomaces that is both safe in operation and that won't damage the wine making ingredients being pumped.

Since the wine must pump 10 and method 200 of the present invention may be readily produced and integrated with existing wine making systems, and since the advantages as described herein are provided, it is expected that it will be readily accepted in the industry. For these and other reasons, it is expected that the utility and industrial applicability of the invention will be both significant in scope and long-lasting in duration.

We claim:

1. A pump for moving a wine product, comprising:

a vacuum chamber having a wine product inlet, a wine product outlet, a vacuum port, and an agitator inlet port;

a vacuum source coupled to said vacuum port for providing a vacuum to said vacuum chamber sufficient to draw a wine product into said chamber through said wine product inlet; and a wine product discharge valve coupled to said wine product outlet for allowing said wine product to be removed from said vacuum chamber; and wherein said agitator inlet port is disposed such that an agitating fluid entering said chamber through said agitator inlet port will impinge on said wine product prior to said wine product entering said wine product discharge valve.

2. A pump according to claim 1, wherein said vacuum source includes an air pump having an intake coupled to said vacuum port and an output coupled to said agitator inlet port.

3. A pump according to claim 2, further comprising a cooling apparatus coupled between said output of said air pump and said agitator inlet port.

4. A pump according to claim 3, further comprising a regulating valve coupled between said output of said air pump and said agitator inlet port.

5. A pump according to claim 2, further comprising a regulating valve coupled between said output of said air pump and said agitator inlet port.

6. A pump according to claim 1, further comprising a compressed fluid supply source coupled to said agitator inlet port.

7. A pump according to claim 6, further comprising a regulating valve coupled between said compressed fluid supply source and said agitator inlet port.

8. A pump according to claim 1, further comprising a regulating valve coupled to said agitator inlet port to control the flow rate of said agitating fluid into said chamber.

9. A pump according to claim 1, wherein:

said product outlet is disposed near the bottom of said vacuum chamber; and said agitator inlet port is disposed adjacent said product outlet.

10. A method for moving a wine product, comprising:

drawing said wine product into a vacuum chamber;

removing said wine product from said vacuum chamber via a product discharge valve; and agitating said wine product with an agitating fluid prior to said product entering said product discharge valve to prevent clogging of said product discharge valve.

11. A method according to claim 10, wherein:

said step of drawing said product into a vacuum chamber includes applying a vacuum to said vacuum chamber via an air pump; and said step of agitating said product includes supplying said agitating fluid from an output of said air pump.

12. A method according to claim 11, further comprising a step of cooling said agitating fluid before said agitating fluid is used to agitate said product.

13. A method according to claim 12, further comprising the step of regulating the flow of said agitating fluid used to agitate said product.

14. A method according to claim 11, further comprising the step of regulating the flow of said agitating fluid used to agitate said product.

15. A method according to claim 10, wherein said step of agitating said product includes agitating said product with a fluid supplied by a compressed fluid source.

16. A method according to claim 15, wherein said step of agitating said product includes regulating the flow of said compressed fluid used to agitate said product.

17. A method according to claim 10, further comprising the step of regulating the flow of said agitating fluid used to agitate said product.

18. A method according to claim 10, wherein said step of agitating said product includes agitating said product near the bottom of said vacuum chamber.

* * * * *